United States Patent [19]

Bolli

[11] 3,950,822

[45] Apr. 20, 1976

[54] DEVICE FOR MANUFACTURING A SILVER USED TO PRODUCE JASPE YARN

[76] Inventor: Giuseppe Bolli, Campore di Vallemosso, Vercelli, Italy

[22] Filed: May 3, 1974

[21] Appl. No.: 466,649

[30] Foreign Application Priority Data

May 11, 1973 Italy ..... 68353/73

[52] U.S. Cl. ..... 19/155; 19/150; 19/237

[51] Int. Cl.[2] ..... D01G 15/70

[58] Field of Search ..... 19/237, 150, 98, 99, 19/100, 106, 145.7, 157, 155; 57/50

[56] References Cited

UNITED STATES PATENTS

| | | | |
|---|---|---|---|
| 411,367 | 9/1889 | Allison | 19/150 X |
| 2,560,013 | 7/1951 | Varga | 19/106 X |
| 2,703,439 | 3/1955 | Dole et al. | 19/106 R |

FOREIGN PATENTS OR APPLICATIONS

| | | | |
|---|---|---|---|
| 1,176 | 1892 | United Kingdom | 19/98 |

*Primary Examiner*—Dorsey Newton
*Attorney, Agent, or Firm*—Sughrue, Rothwell, Mion, Zinn & Macpeak

[57] ABSTRACT

A fiber web for use in the manufacture of slub or jaspé yarn is produced by a modification of a carding engine whereby a final fancy roller is mounted on a controllably movable support for movement towards and away from the surface of the carding drum, thereby varying the thickness of the sliver obtained before the sliver enters the doffing cylinder. The movement of the fancy roller may be controlled by a programme carried on an endless tape.

5 Claims, 7 Drawing Figures

DEVICE FOR MANUFACTURING A SILVER USED TO PRODUCE JASPE YARN

BACKGROUND OF THE INVENTION

This invention relates to the manufacture of a sliver having varying thickness along its length used in the production of slub or jaspé yarns, that is yarns which have irregularly disposed thickened regions of different lengths.

In order to obtain such jaspé yarns, which are used to obtain certain types of fabric (boucle fabric or the like) a preparation treatment is required which must be carried out on the semi-worked material before the spinning proper.

Generally such preparation is carried out during the drawing of the yarn, working on the resulting roving by subdividing the web of carding into strips.

As already known, when a roving passes through a drawing frame formed by at least two pairs of pressure rollers arranged in cascade, the rollers of the second pair rotating at a greater speed than those of the first pair, the roving lengthens and takes on the physical and mechanical characteristics required for the following spinning operation.

If, during the drawing stage the speed of the second pair of rollers is changed the consistency and mechanical characteristics of the treated roving are no longer constant and the resulting dimensional variations give rise in the finished product to the jaspé yarn proper.

In general, the variation of speed of the second pair of drawing rollers is caused by programed devices, prepared beforehand, which determine the length of the individual slubs and their arrangement in the yarn.

It is evident that with this system there have to be set up as many slubbing devices as there are drawing frames through which the rovings to be treated pass.

Furthermore, the dimensional variations obtained in the drawing stage reduce the mechanical characteristics of the yarns obtained which, similarly to other characteristics, results in the yarns being less resistant to breakage than those devoid of slubbing.

The object of the present invention is to avoid the above disadvantages by providing an apparatus using a carding engine which allows a reduction in the number of slubbing devices, allowing the drawing frames to remain unchanged and therefore avoiding the costly modifications required to produce a sliver having varying thickness along its length for the manufacture of jaspé yarn, and which allows treatment in a simple and quick way of the semi-worked material from which jaspé yarns are obtained, in such a way that the yarns obtained have better mechanical characteristics than those obtained by the traditional processes.

SUMMARY OF THE INVENTION

The main characteristics of the apparatus according to this invention resides in the fact that it consists in working on the web of fibers directly during carding by varying in a controlled way the radial distance of the last fancy roller relative to the carding drum of the carding engine and thereby varying the thickness of the web obtained, before it passes through the doffing cylinder.

The apparatus for carrying out the invention comprises a carding engine in which the last fancy roller is mounted on displaceable supports such as to allow controlled radial displacements of the fancy roller to vary the distance between the peripheral surface of the fancy roller and that of the carding drum.

BRIEF DESCRIPTION OF THE DRAWINGS

Further characteristics and advantages of the invention will emerge in the course of the detailed description which follows, with reference to the accompanying drawings, given by way of non limiting example, in which.

DETAILED DESCRIPTION OF THE ILLUSTRATED EMBODIMENT

Figure 1:
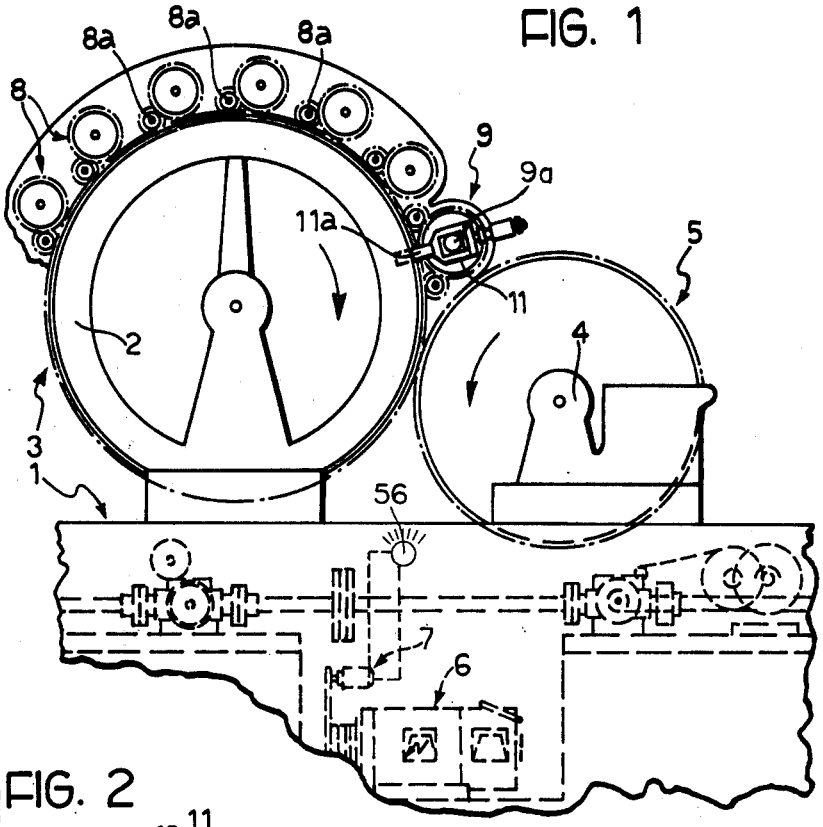
FIG. 1 is a schematic partial side view in elevation of a carding engine provided with an apparatus for the preparation of slub yarns according to the present invention.

FIG. 1 illustrates schematically a carding engine of the traditional type, comprising a base 1 provided with shaped sides 2 which support a main carding drum 3 and with further sides 4 which support a doffer 5. The drum 3 and doffer 5 are driven by means of drive transmissions from direct current motor 6 or by a motor variator to which a tachometric generator is connected.

The carding drum 3 cooperates with a number of worker rollers 8 associated with stripper rollers 8*a* and with a fancy roll 9, normally with a diameter larger than the preceding ones.

According to this invention, the fancy roll 9 is carried by supports 10 displaceably mounted on guides 11 which project from the sides 2 which support the carding drum 3 and fixed radially to the sides by brackets 11*a*.

Figure 2:
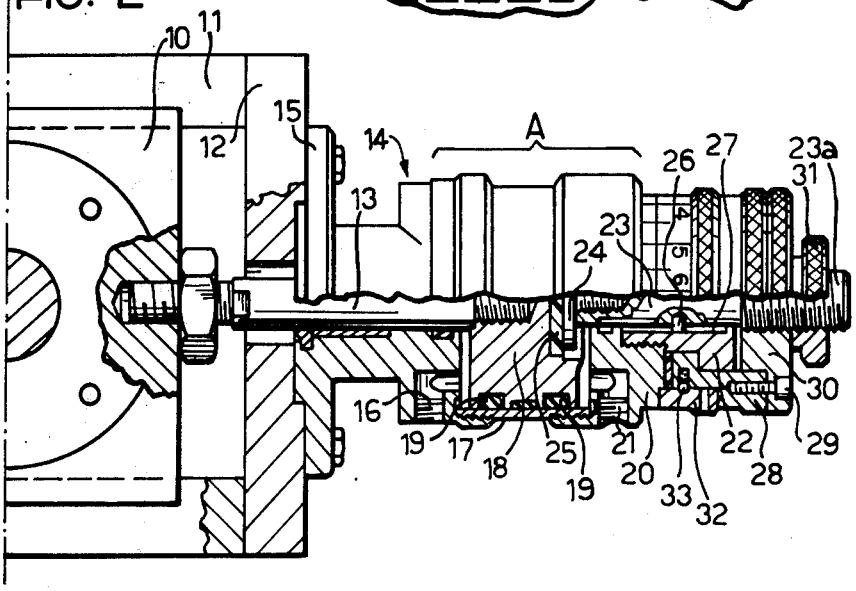
FIG. 2 is a side view partially in section and on an enlarged scale of a detail of the apparatus.

As illustrated in FIG. 2, each guide 11 is provided with parallel sides disposed radially with respect to the drum 3 and the corresponding displaceable support 10 of the fancy roll 9 is connected to a rod 13 of a piston 18 which slides in a double-acting fluid pressure cylinder A. Fluid under pressure is fed to the opposite ends of the cylinder A alternately so as to cause controlled radial displacements in both directions of the fancy roller, which therefore moves towards and away from the carding drum 3, causing corresponding variations in the thickness of the web of fibers produced.

When the web has been subsequently subdivided into rovings, the latter may undergo normal drawing operations, keeping the dimensional variations caused in the web by the displacements of the flywheel roll 9, so as to form a slub or jaspé yarn after the spinning operation.

As shown in FIG. 2, each double-acting fluid pressure cylinder A has a head 14 provided with an external flange 15 for connection to a transverse plate 12 of the guide 11. The cylinder A is formed by a cylindrical casing 17, and by a second head 20 opposite the first head 14. In the two heads 14, 20 there are provided respective lateral inlet and outlet ports 16, 21 communicating with the opposite ends of the cylinder A. A piston 18 slides in the chamber delimited by the cylindrical casing 17 and is provided with annular seals 19 at its opposite ends.

To the second head 20 there is attached, by screw engagement in an internally threaded axially extending socket, a bush 22 in which an axially slidable rod 23 is located. The rod 23 carries at its inner end an enlarged head 24 which constitutes a stop at one end of the cylinder A. The piston 18 abuts this stop through the interposition of an elastic bearing pad 25. The rod 23 is provided with a radially projecting key 26 which slides in a longitudinal slot 27 in the bush 22 to prevent rotation of the rod while allowing axial displacement thereof.

The bush 22 is surrounded by a rotatable adjuster ring 28 which is connected by means of axial screws 29 to an internally threaded ring nut 30 cooperating with a threaded rear end 23*a* of the rod 23. Consequently, by acting upon the ring 28 manually, rotation of the ring nut 30 in one direction or the other can be effected, displacing the rod 23 axially so as to vary the distance between the stop head 24 and the piston 18 of the fluid pressure cylinder A. A locking ring nut 31 threaded on the end 23*a* of the rod 23 enables the latter to be locked in its set position. The adjuster ring 28 is provided on the outside with graduations which cooperate with fixed graduations or notches in order to form a vernier scale.

On the outside of the adjuster ring 28 a zero-setting ring 32 is located. The ring 28 has a torsional connection to the adjuster ring 28 constituted by a ball 33, loaded by a spring housed in the ring 28 and urged into engagement with internal notches in the ring 32. The zero-setting ring 32 can be adjusted angularly relative to the adjuster ring 28 to set the zero of the vernier scale associated with the ring 28.

By means of the vernier scale it is possible to determine the magnitude of the stroke of each piston within its cylinder, to regulate the maximum distance of the fancy roll 9 from the carding drum 3. For the return stroke of the pistons no regulation is required.

Figure 3:
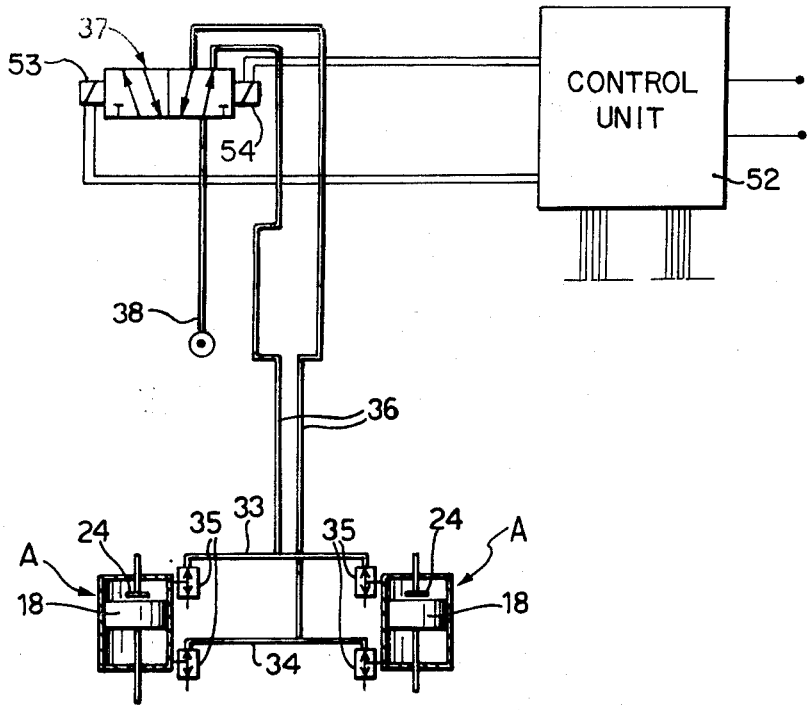
FIG. 3 is a diagram illustrating the operation of the apparatus according to this invention.

As illustrated in FIG. 3, the two double-acting fluid pressure cylinders A are connected in parallel with each other by conduits 33, 34 with the interposition of valves 35 for rapid exhaustion of the cylinders. The conduits 33, 34 are connected by pipes 36 to a distributor 37 controlled by two associated electrovalves 53 and 54, operable to connect the opposite respective ends of the two cylinders A with a fluid pressure supply line 38 or with an exhaust outlet respectively.

Figure 4:
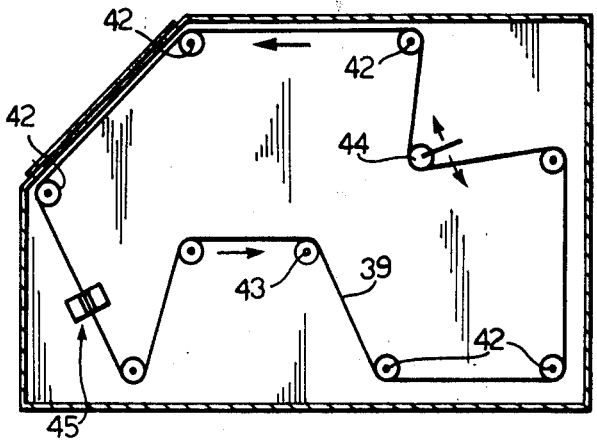
FIG. 4 is a schematic longitudinal section of a detail of the apparatus according to this invention.
Figure 5:
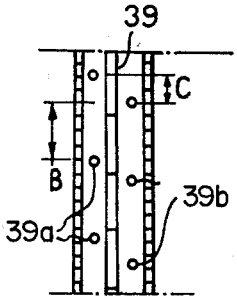
FIG. 5 is a partial front view of the programme tape used in the control of the apparatus.
Figure 6:
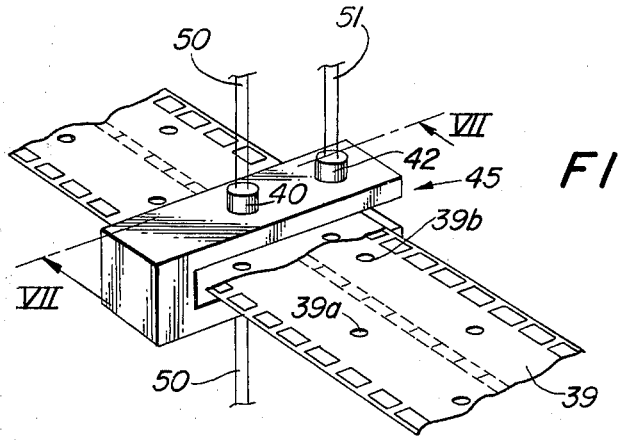
FIG. 6 is a schematic enlarged perspective view of another detail of the apparatus.
Figure 7:
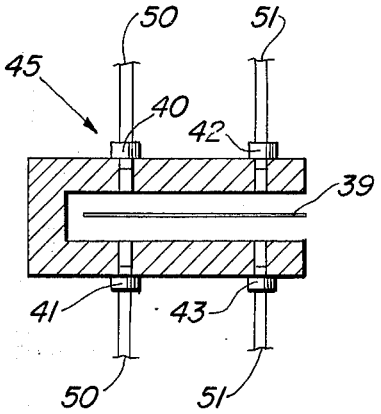
FIG. 7 is a sectional view taken along line VII—VII of FIG. 6.

The distributor 37, or better the electrovalves 53 and 54 which are part of it, are controlled by an endless program tape 39 (FIG. 4) passing over a number of guide rollers 42. The tape 39 is driven by a drive sprocket 43 and is maintained in tension by a tension roller 44 mounted on an oscillating support. The program tape 39 is preferably formed by a film with side perforations for engagement by the drive sprocket 43, the film also having two series of perforations 39*a*, 39*b* spaced apart by different distances, in order to form thickenings which will constitute the eventual slub or jaspé yarn. Each series of perforations 39*a*, 39*b*, cooperates with a respective photo-diode and source of light, mounted on a single support 45 located at a straight run of the tape 39.

Each photo-diode/source of light unit is electrically connected, by means of leads 50 and 51, with an electronic selector 52. The latter controls the electrovalves 53 and 54 of distributor 37.

The photo-diode/light source pair 41–40 is in register with the perforation row 39*a* of the program tape 39, while the photo-diode/light source unit 42–43 is in register with the perforation row 39*b* of the same tape. Whenever one of the perforations 39*b* happens to come between the photo-diode and the light source of the pair 42–43, the selector 52 excites the coil of electrovalve 53 and the distributor 37 puts itself in a position to cause the roller 9 to turn away from the carding drum 3.

On the other hand, whenever one of the perforations 39*a* happens to come between the photo-diode and the light source of the pair 40–41, the selector 52 excites the coil 54 and the distributor 37 is put into a position to cause the roller 9 to turn near to the carding drum 3.

The perforations 39*b* of one series, cooperating with the respective photodiode, control the operation of one of the electrovalves of the distributor 37 causing the separation of the fancy roll 9 from the carding drum 3; the perforations 39*a* of the other series control the other photodiode, which in turn controls the operation of the other electrovalve of the distributor 37 to cause the fancy roll 9 to approach the carding drum 3. Thus the distance between the perforations of the two series determine respectively the times C of the duration of the periods of separation of the fancy roll 9 from the drum 3, and therefore the length of the slub yarn and the duration B of the pauses, which dictate the distance between the thickenings or slubs in the yarn.

The program tape is prepared in advance according to the number, length and the desired distance between the slubs.

The drive sprocket 43 which drives the program tape, is controlled by the tacho-generator 7, so as to maintain in strict relation to each other the speed of advance of the tape and the speed of the carding drum 3.

By means of a suitable 56 it is possible to vary the velocity ratio between the tacho-generator 7 and the drive motor of the carding machine to obtain, with the same program tape, a different disposition of the slubs.

In addition, means already known are envisaged to prevent the cyclic repetition of the slubs and determine instead the staggering of the slubs on the web produced.

The apparatus herein described allow the preparation of semi-worked fibers for the production of slub or jaspe yarns, without making any modification to the existing drawing frames, thus reducing the installation expenses, having regard to the fact that a single device, working on the web, is able to cause thickening corresponding to the slubs in all the rovings which are formed in the web itself. The yarns produced are furthermore very strong compared with those obtained by traditional methods, as the conditions of drawing during the intermediate working of the rovings are not changed.

It will be understood that while adhering to the principle of this invention, embodiments and manufacturing details can be widely varied, with respect to what has been described and illustrated, without departing from the scope of this invention. Thus for example the shaft of the fancy roll could be carried by supports movable along paths which are not strictly radial, as in the example illustrated.

I claim:

1. Apparatus for the preparation of a web of textile fibers slivers having varying thickness along their lengths, used for the production of jaspe, comprising a carding engine having a drive motor, a carding drum and a plurality of worker rolls cooperating with said drum, to comb fibers thereon wherein the last worker roll acts as a fancy roll, and including support means supporting opposite ends of said fancy roll, and means to automatically and alternately displace said support means towards and away from the carding drum to effect controlled displacement of said fancy roll relative to said carding drum to vary the distance between the peripheral surface of said fancy roll and that of said carding drum, and means to remove said fibers from said carding drum to thereby cause a corresponding variation in the thickness of the fibers on said carding drum.

2. The apparatus defined in claim 1, in which the automatic displacing means of the fancy roll support means comprise two doubleacting fluid pressure actuator cylinders having pistons rigidly connected to said support means, which support the opposite ends of the shaft of the fancy roll, the apparatus further including electrovalves controlling said fluid pressure actator cylinders, an electronic control unit providing electrical control signals which control said electrovalves, and program means including an endless flexible tape cooperating with and movable through the electronic control unit, said tape storing a predetermined program.

3. The apparatus defined in claim 2, wherein the program means comprise two photodiodes and two sources of light which direct light onto said respective photodiodes through the two sides of the tape, said photodiodes cooperating with two series of perforations spaced from each other by different distances at said two sides of the tape, a first of said electrovalves arranged to cause movement of the fancy roll away from the carding drum under control of one of said photodiodes and a second of said electrovalves arranged to cause the return of the fancy roll towards the carding drum, under control of the other of said photodiode.

4. The apparatus defined in claim 2, wherein each of the fluid pressure actuator cylinders which control the displacements of the support means of the fancy roll is provided internally with an adjustable stop adapted to limit the movement of the fancy roll away from the carding drum, and including means adjusting said stop from the outside, comprising a rotatable annular control member cooperating by means of a threaded rod connected to the stop, said annular control member being provided with fixed graduations which form a venier scale.

5. The apparatus defined in claim 3, including means controlling the movement of the program tape, comprising a tachometric generator connected to the drive motor of the carding engine and maintaining, in operation, a fixed relation between the carding drum and the tape, independently of the speed of said drive motor, and regulator means for varying said relation.

* * * * *